United States Patent [19]

Suzuki

[11] Patent Number: 4,989,379

[45] Date of Patent: Feb. 5, 1991

[54] FOLDING HOUSE

[75] Inventor: Nobuo Suzuki, Osaka, Japan

[73] Assignee: Yugen Kaisha Suzuki House, Osaka, Japan

[21] Appl. No.: 494,086

[22] Filed: Mar. 7, 1990

[51] Int. Cl.[5] ..... E04B 1/346

[52] U.S. Cl. ..... 52/66; 52/71

[58] Field of Search ..... 52/71, 79.5, 67, 66, 52/69–70

[56] References Cited

U.S. PATENT DOCUMENTS

| | | | |
|---|---|---|---|
| 2,883,713 | 4/1959 | Zug | 52/71 |
| 3,044,129 | 7/1962 | Bigelow | 52/71 |
| 3,280,796 | 10/1966 | Hatcher | 52/70 X |
| 3,324,831 | 6/1967 | St. Onge | 52/71 X |
| 3,983,665 | 10/1976 | Burton | 52/71 |
| 4,035,964 | 7/1977 | Robinson | 52/71 X |
| 4,112,633 | 9/1978 | Mitchell | 52/71 X |
| 4,118,901 | 10/1978 | Johnson | 52/70 X |
| 4,603,658 | 8/1986 | Garnsey | 52/70 X |

FOREIGN PATENT DOCUMENTS

| | | | |
|---|---|---|---|
| 2454985 | 5/1975 | Fed. Rep. of Germany | 52/71 |
| 2549420 | 5/1976 | Fed. Rep. of Germany | 52/66 |

*Primary Examiner*—Gary L. Smith
*Assistant Examiner*—Suzanne L. Dino
*Attorney, Agent, or Firm*—Edwin E. Greigg

[57] ABSTRACT

A folding house which has at least one folding part consisting of a roof which can be folded freely at its center line so that the center part would sink down, a floor which can be folded freely at its center line so that the center part would go up and two side walls which can be freely folded inside. The folding house can diminish the time for construction and dismantlement, rationalize transportation and storage and simplify the labor.

5 Claims, 10 Drawing Sheets

A
5a
5b
4
8
7
3

12
4
12
1
11
1
1
5a
12
1
12
5b
8
14
3
2
6b
7
14
14

FOLDING HOUSE

BACKGROUND OF THE INVENTION

1. Field of the Invention

This invention relates to a prefab building designed for use as a temporary building in an emergency, a field office and a warehouse.

2. Description of the Prior Art

It is known in the art to use a prefab building for a temporary building in an emergency, a field office and a warehouse. Heretofore the principal means to achieve such usage was a house which was completed beforehand and then moved and placed at a predetermined place.

However, in this case, there occurred problems that a large space for storage was needed and that efficiency of transportation was quite low because the number of the houses which could be carried on one truck at a time was restricted by the floor area of the truck. Furthermore, the width of a house was restricted to 2.4 meters because of limits on the floor width of a truck.

However, it has long been considered that the width of 2.4 meters was too narrow and that at least 3.0 meters was necessary in view of human factors engineering, i.e., liveability.

To solve these problems, there was developed a house whose roof, floor, walls and some other parts were panels which could be jointed or disjointed each by each. This house was constructed on site only when it was needed.

However, this house constructed of panels still had large problems in that the panels were likely to be damaged during transportation and in that the house required a lot of time and effort in construction and dismantlement at the building site.

Furthermore, even in this case, it was impossible to carry a panel whose width was about 3 meter on a truck.

To solve these problems, this inventor proposed a folding house which was filed in Japan on Mar. 16, 1985 under Japanese patent application No. 60-53003. This invention provides a folding house whose floor panel, wall panels and roof panel are connected so as to be folded.

OBJECT AND SUMMARY OF THE INVENTION

An object of this invention is to provide a folding house which can diminish the time for construction and dismantlement, improve its transportation and storage, and reduce the labor component inerection.

To achieve the above object, a folding house according to this invention is characterized in that the folding house has at least one folding part consisting of a roof which can be freely folded at its center line so that the center part would sink down, a floor which can be freely folded at its center line so that the center part would rise up and side walls which can be freely folded inside. Said folding house is also characterized in that it has at least one door on either said side walls or fixed walls.

Further, said folding part might be concatenated with a fixed box structure consisting of a roof, walls and a floor or it might be concatenated to both sides of the fixed box structure.

Furthermore, hook means to allow the folding house to be lifted are formed at the edge of the roof of said folding house and at the center part of the roof.

Further, each top end of the fixed walls has a horizontal projection inside which is at least of the same thickness as said side walls and whose end is connected with the roof, and each bottom end of the fixed walls has a horizontal projection inside which is at least of the same thickness as said side walls and whose end is connected with the floor.

BRIEF DESCRIPTION OF THE DRAWINGS

The drawings FIG. 1 through FIG. 5 show a first embodiment of this invention in which:

FIG. 1 is a perspective view of a folding house in the condition of being folded, FIG. 2 and FIG. 3 are perspective views of a folding house under construction, FIG. 4 is a sectional view of a folding house under construction, FIG. 5 is a perspective view of a folding house after construction.

The drawings FIG. 6 through FIG. 10 show a second embodiment of this invention in which:

FIG. 6 is a side sectional view of a folding house in the condition of being folded, FIG. 7 is a perspective view of a folding house in the condition of being folded, FIG. 8 is a side sectional view of a folding house under construction, FIG. 9 is a side sectional view of a folding house after construction, FIG. 10 is a perspective view of a folding house after construction.

DETAILED DESCRIPTION OF THE PREFERRED EMBODIMENT

Figure 1:
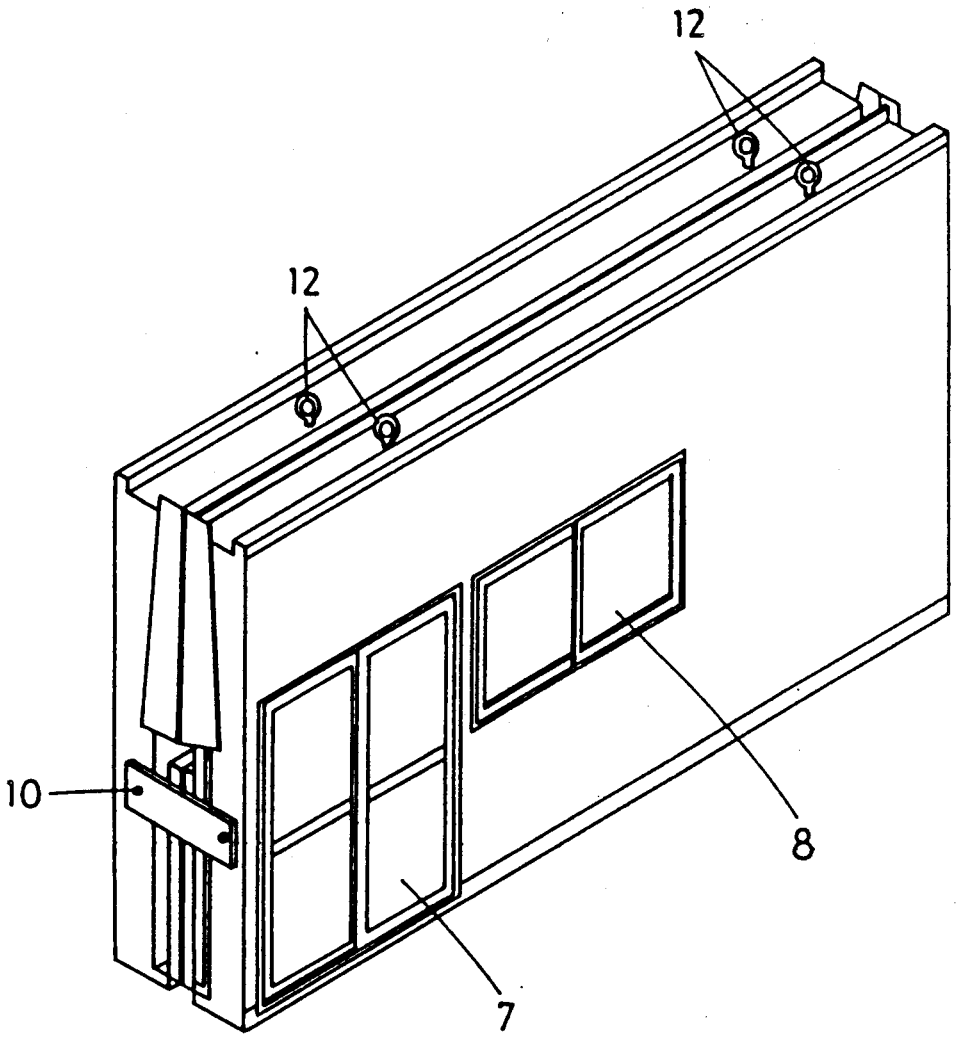

The preferred embodiments of the present invention will be below described in detail with reference to the drawings.

FIG. 1 through FIG. 5 show the first embodiment.

A folding house in the first embodiment mainly consists of a floor panel 3, a roof panel 4, fixed wall panels 5*a*, 5*b* and movable wall panels 6*a*, 6*b*.

The floor panel 3 is divided into two parts at the center line where four butt hinges 2 are provided so that the center part will go up and the floor panel will be folded. Those butt hinges are metalic and each of them is approximately 120 mm long.

The roof panel 4 is divided into two parts at the center line where four butt hinges 1 are provided so that the center part will go down and the roof panel will be folded. Those butt hinges are metalic and each of them is approximately 120 mm long.

The fixed wall panel 5*a* is a front wall, the fixed wall panel 5*b* is a back wall, the moveable wall panel 6*a* is a right side wall and the movable wall panel 6*b* is a left side wall. The movable wall panel 6*b* is connected to the fixed wall panel 5*a* by means of some butt hinges 14 which are the same as the butt hinges 1 and 2 so that it can be freely folded inside.

The movable wall panel 6*a* is connected to the fixed wall panel 5*b* by means of some butt hinges 14 so that it can be freely folded inside.

The floor panel 3, the roof panel 4 and the movable wall panels 6*a*, 6*b* form a folding part A.

In this embodiment, the fixed wall panel 5*a* has a door 7 and a window 8, the fixed wall panel 5*b* has a window 8 and the movable wall panel 6*a* has a ventilating opening 13.

The fixed wall panels 5*a*, 5*b* and the movable wall panels 6*a*, 6*b* integrate bracing members 16.

Each top end of the fixed wall panels 5*a*, 5*b* has a horizontal projection inside which is at least of the same thickness as the movable wall panels 6*a*, 6*b*. The edge of each projection is connected with the roof panel 4 by means of butt hinges 14 which are placed a little inside of the edge of the roof panel 4 so that the roof panel 4 can be folded freely.

Further, each bottom end of the fixed wall panels 5*a*, 5*b* has a horizontal projection inside which is at least of the same thickness as the movable wall panels 6*a*, 6*b*. The edge of each projection is connected with the floor panel 3 by means of butt hinges 14 so that the floor panel 3 can be folded freely.

Figure 3:
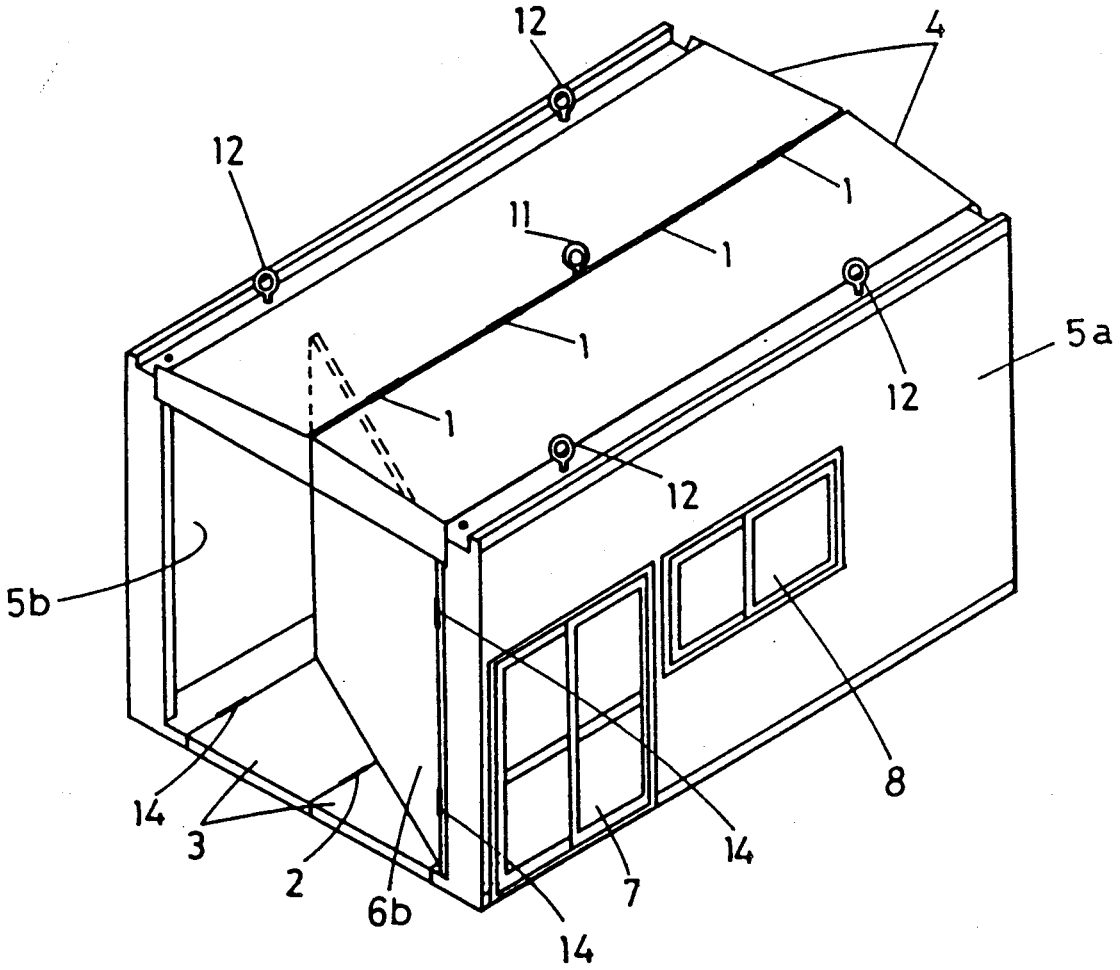
Figure 4:
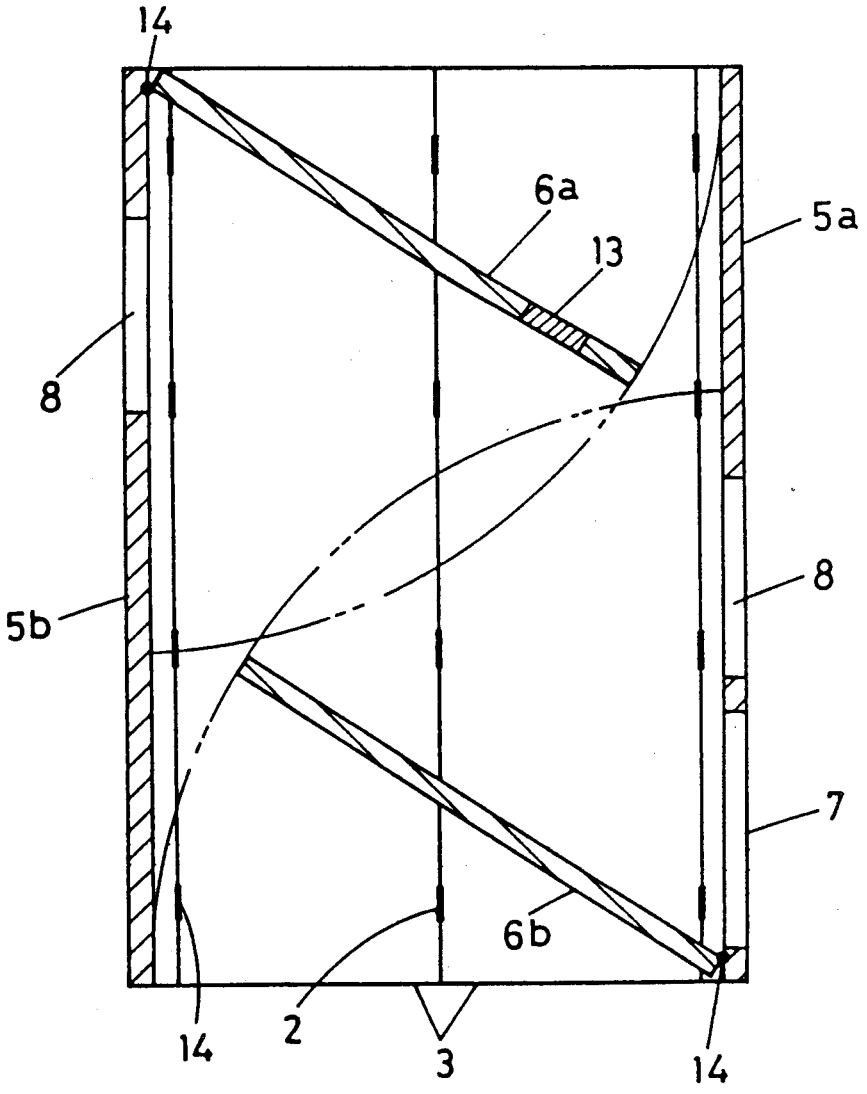
Figure 5:
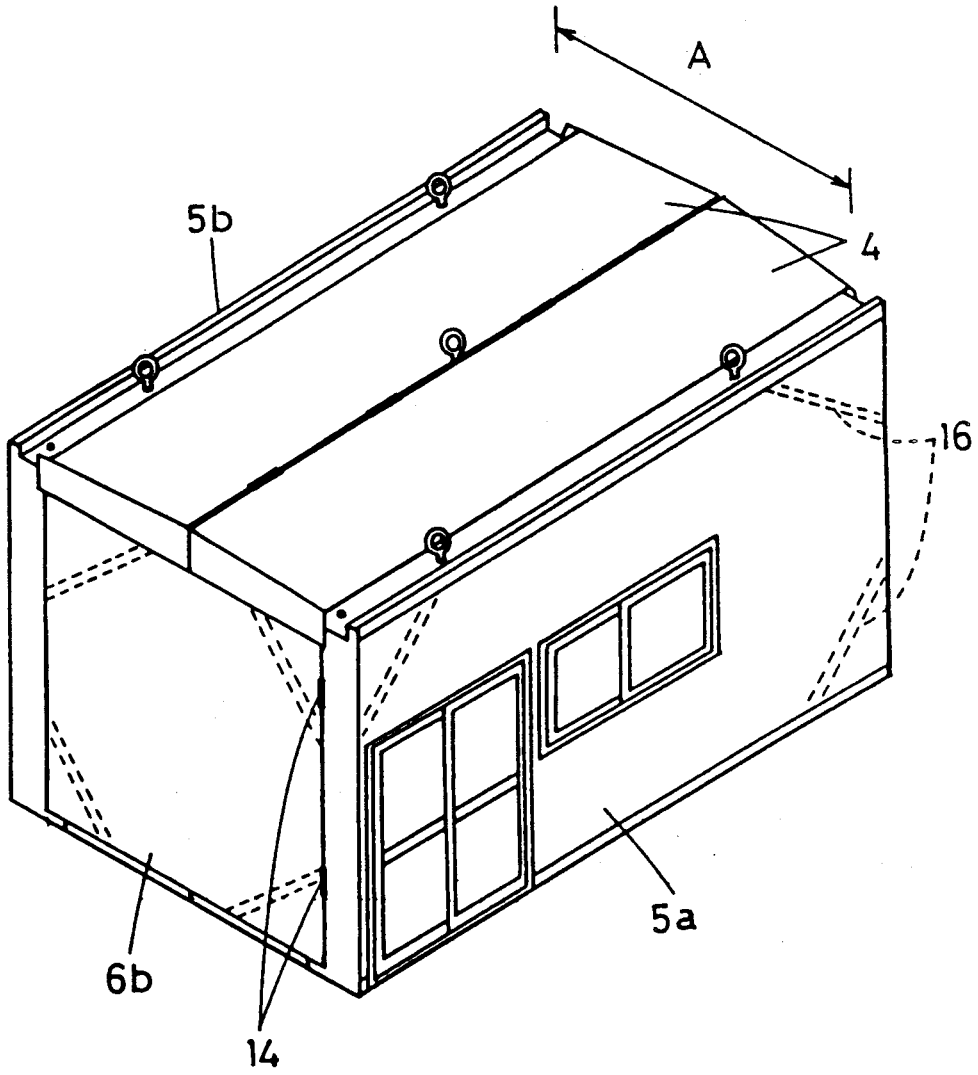
Figure 6:
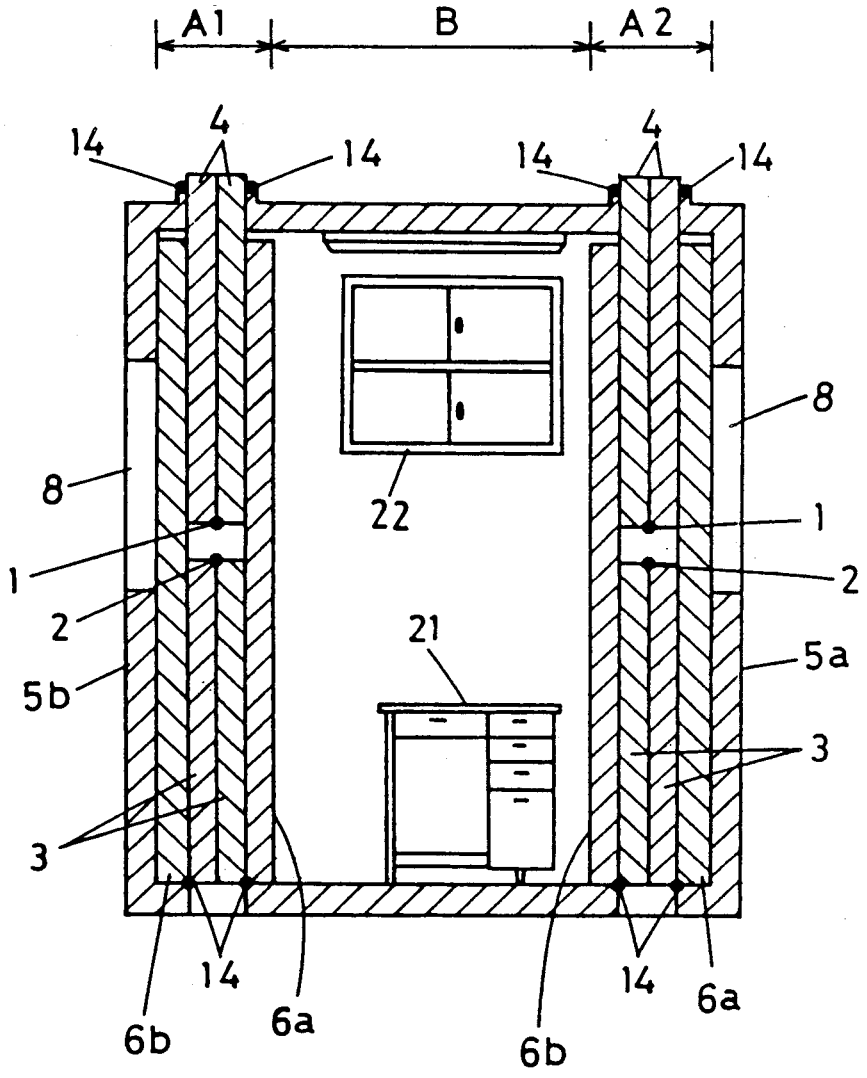
Figure 7:
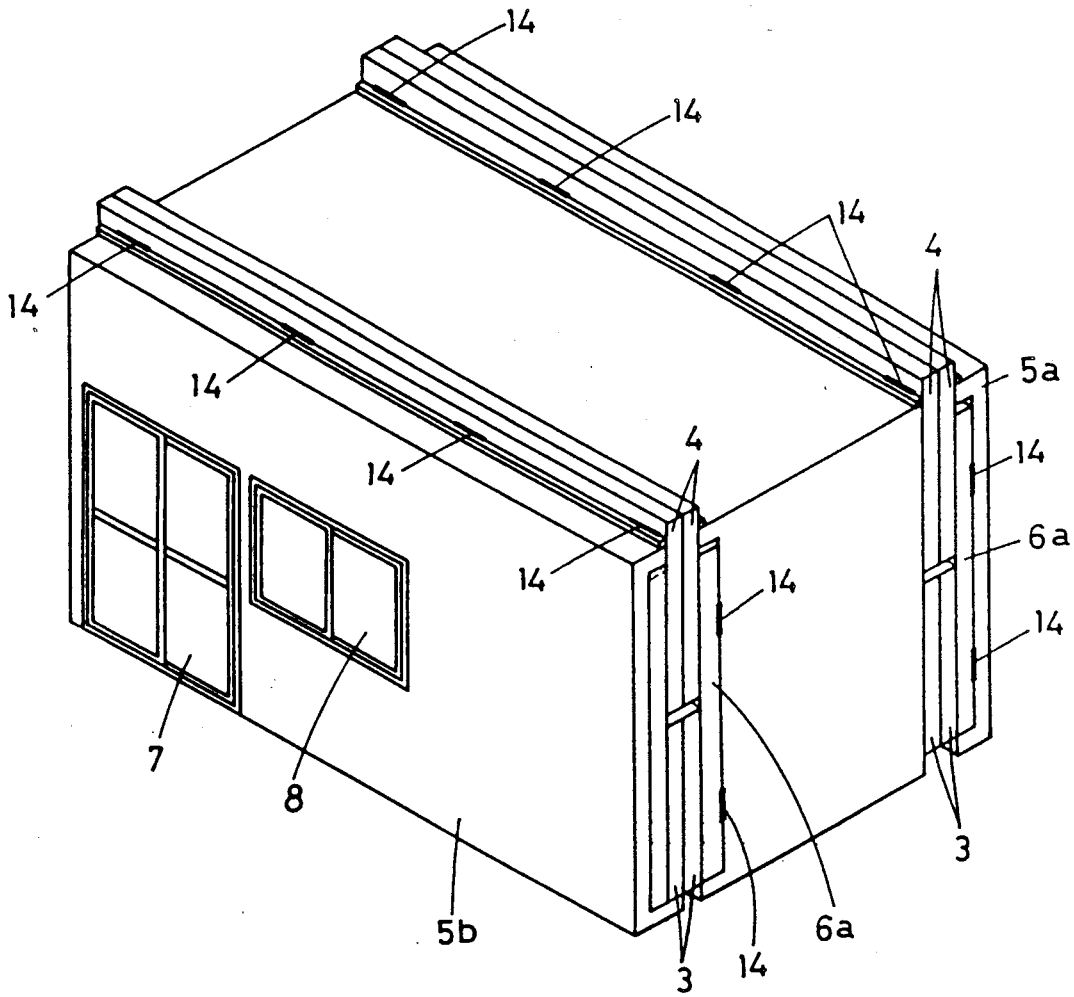
Figure 8:
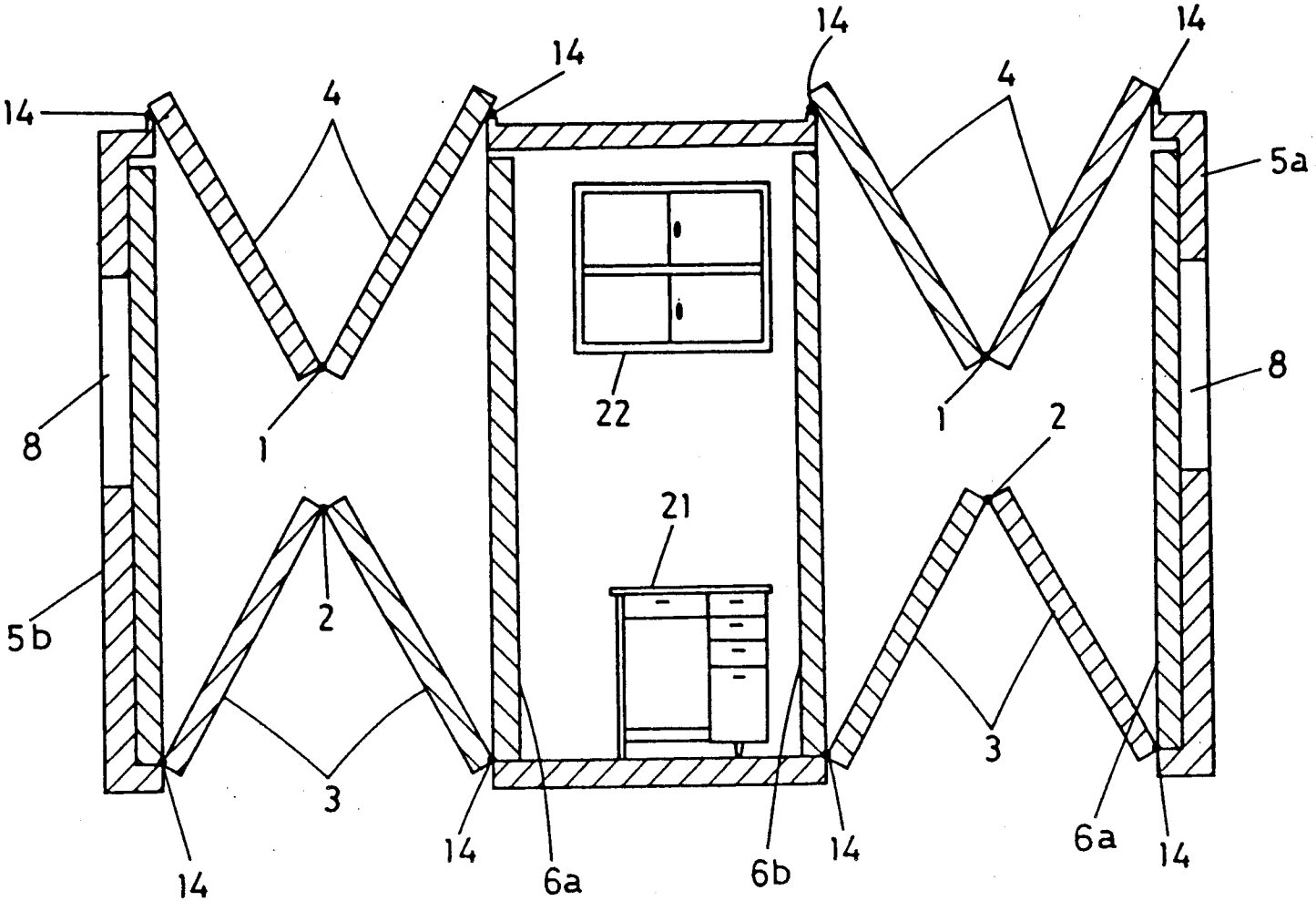
Figure 9:
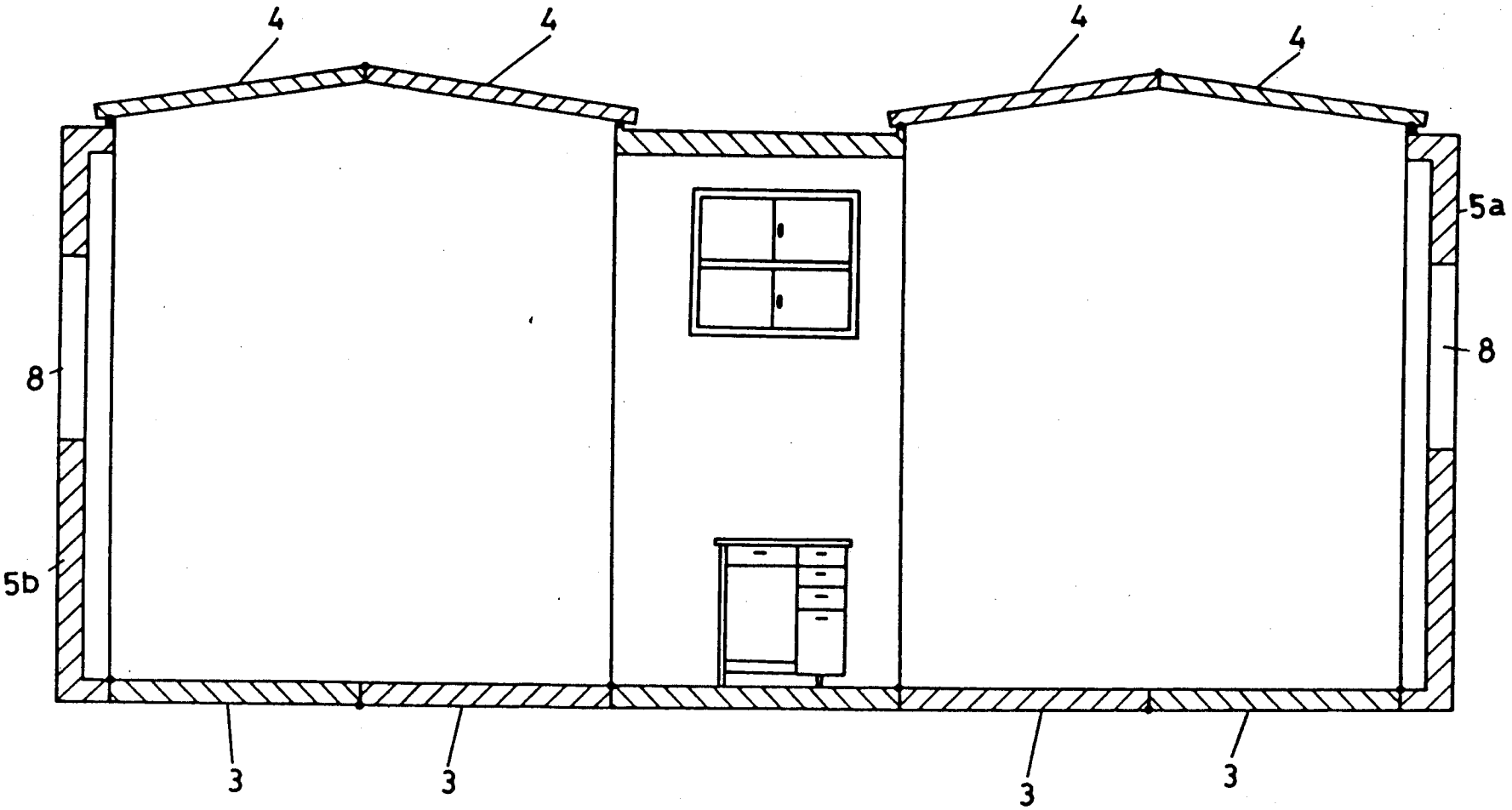
Figure 10:
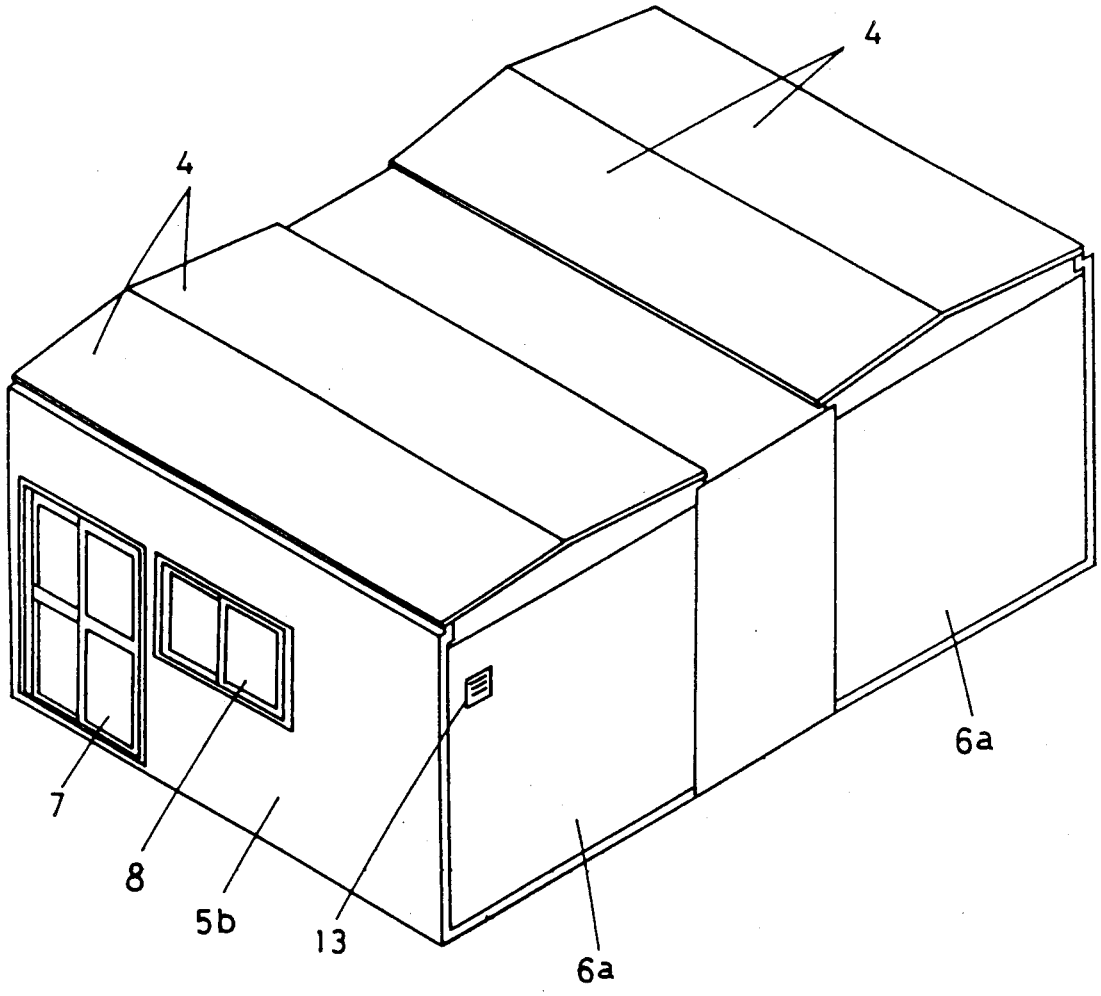

In order to fold said folding house, the movable wall panels 6*a*, 6*b* are folded into inside of the house first. In this situation, when ropes which are hanging from metal fittings 12 in FIG. 3 are pulled up little by little, the fixed wall panels 5*a*, 5*b* are pulled each other, the roof panel 4 being folded as the center part of it sinks down at the butt hinges 1 and the floor panel 3 being folded as the center part of it goes up by means of butt hinges 2.

Thereafter, both sides of the folded house are tightly locked by fastenings 10 as shown in FIG. 1.

When transporting the folding house, we pull up the wireropes hung from the metal fittings 12 by a crane and put the folding house on the transportation.

As shown in FIG. 1, as a folding house in this embodiment has a small base area in the state of being folded, we can load more of them on the same base area at a time than before. Therefore, transporting fee for each will be diminished.

Further, as said folding house is folded after most structural parts of it are connected to it, we never forget bringing any of them.

Figure 2:
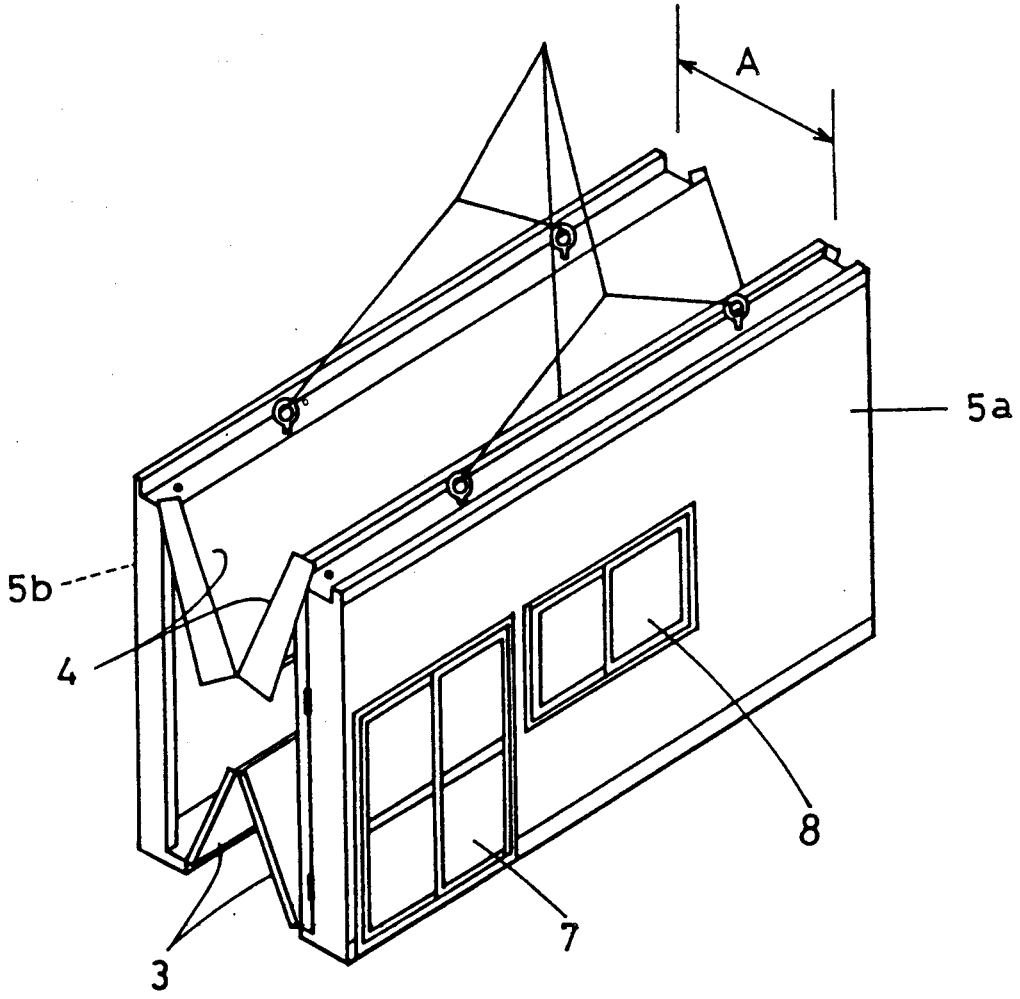

When arriving at the designation where the folding house will be built, we first pull it up through the metal fittings 12 by a crane, put it on the designated place where square bars have been already placed and put off the fastenings 10. Accordingly, as we pull up the folding house again and pull up the wire hung from the fitting 11 slowly, the roof panel 4 opens and the floor panel 3 also opens by its own weight as shown in FIG. 1 through FIG. 3. Thereupon, the folding house is put on the designated place again and the hooks of the crane are put off.

Accordingly, as shown in FIG. 3, we open the folded movable wall panels 6*a*, 6*b* by hands and fix them with locking bolts. In this way, the opening procedure of the folding house is completed.

The movable wall panels 6*a*, 6*b* is opened easily just as when we open the door by pushing it. Further, as they will be fixed tightly with locking bolts, there is no possibility that the folding house might contort.

Further, the roof panel 4 may be fixed by a beam which has been enclosed along the roof panel by turning it on an axis. A more preferable thing is to fix a lighting equipment to the beam.

In this way, a house with large floor area which is not restricted because of the width of carriers as before can be obtained. For example, even a large floor area or 3 meter's width, which is also superior in view of human engineering, will be obtained by dividing the floor panel into two 1.5 meter's width's panels when transporting it.

We can provide a house with a larger floor area by connecting another folding house side by side. A folding house may be connected on another folding house as a second floor.

Water proof effect will increase if water proof seal covers around the butt hinges on the roof.

The second embodiment is shown in FIG. 6 through FIG. 10.

In FIG. 6 through FIG. 10, A1 and A2 are folding parts between which a fixed structure B is concatenated and fixed wall panels 5*b* and 5*a* are concatenated outside of said folding parts A1 and A2 respectively.

As those parts which have the same function as in FIG. 1 through FIG. 5 are samely numbered in FIG. 6 through FIG. 10, the explanation of their functions are omitted.

Said fixed structure B is a box type constructed of a roof, two walls and a floor. Wall panels 6*b*, 6*a* are connected with butt hinges 14 so that they can be folded freely.

A desk 21, a shelf 22 and some other fixtures such as a lighting equipment are fixed inside of said fixed structure B.

As a folding house according to this embodiment can be stored and conveyed in condition that some fixtures are equipped inside, it can be used as soon as it is constructed.

Further, said fixed structure can be constructed much easier by using a simple oil pressure equipment.

Further, though said folding house has two folding parts, it is enough if it has one folding part and one fixed structure. It is needless to say that there might be more than two of them.

Further, the center line of the roof and that of the floor should only be parallel each other.

What is claimed is:

1. A folding house which can be reduced in size when it is transported comprising fixed walls, at least one folding part including a roof which can be freely folded at its center line so that the center part sinks downwardly during folding, a floor which can be freely folded at its center line so that the center part extends upwardly during folding and non-foldable, one piece side walls which can be freely folded inside prior to folding said roof and said floor, and at least one door on either of said side walls or fixed walls.

2. A folding house as claimed in claim 1, wherein a fixed box structure consisting of a roof, side walls, fixed walls and a floor is connected to said at least one folding part.

3. A folding house as claimed in claim 1, wherein said folding parts are connected to opposite sides of a fixed box structure comprising a roof, side and fixed walls, and a floor.

4. A folding house as claimed in claim 1, which includes hooking parts formed at an edge of the roof of said folding house and at the center part of the roof to pull up said folding house.

5. A folding house as claimed in claim 1, wherein each top end of said fixed walls has a horizontal shoulder projecting inside whose end is connected with the roof, and each bottom end of said fixed walls has a horizontal projection inside whose end is connected with the floor.

* * * * *